US005970875A

United States Patent [19]

Hoffmann et al.

[11] Patent Number: 5,970,875

[45] Date of Patent: Oct. 26, 1999

[54] PRESSURE-SENSITIVE TAMPER EVIDENT SYSTEM

[75] Inventors: Donald J. Hoffmann, Elmhurst; John C. H. Chang, Naperville, both of Ill.

[73] Assignee: Wallace Computer Services, Inc., Hillside, Ill.

[21] Appl. No.: 08/940,201

[22] Filed: Sep. 29, 1997

[51] Int. Cl.[6] ..... B41F 31/00

[52] U.S. Cl. ..... 101/491; 283/95; 503/201; 503/218; 503/213; 503/226

[58] Field of Search ..... 101/491, 487, 101/494, 486; 283/72, 95, 58, 60.1, 60.2; 462/18; 428/327; 355/27; 503/500, 201, 213, 218, 225, 226, 227

[56] References Cited

U.S. PATENT DOCUMENTS

| | | | |
|---|---|---|---|
| 4,317,743 | 3/1982 | Chang | 252/316 |
| 4,448,445 | 5/1984 | Chang et al. | 346/206 |
| 4,846,502 | 7/1989 | Chang et al. | 283/57 |
| 5,029,901 | 7/1991 | Dutson et al. | 462/18 |
| 5,033,773 | 7/1991 | Brunea et al. | 283/95 |
| 5,209,513 | 5/1993 | Batelli et al. | 283/67 |
| 5,250,492 | 10/1993 | Outson et al. | 503/201 |
| 5,284,816 | 2/1994 | Stephenson | 503/227 |
| 5,292,283 | 3/1994 | Koper et al. | 462/18 |
| 5,295,906 | 3/1994 | Skees | 462/18 |
| 5,309,196 | 5/1994 | Sanders | 355/27 |
| 5,325,721 | 7/1994 | Pendergrass, Jr. | 428/327 |
| 5,395,138 | 3/1995 | Chang | 282/95 |
| 5,575,214 | 11/1996 | Braunstein et al. | 101/487 |
| 5,605,873 | 2/1997 | Chang | 503/201 |
| B1 4,425,386 | 3/1988 | Chang | 427/256 |

OTHER PUBLICATIONS

Research Disclosure (No. 18747), Nov. 1979, pp. 638–639.

*Primary Examiner*—Eugene H. Eickholt
*Attorney, Agent, or Firm*—Roylance, Abrams, Berdo & Goodman, L.L.P.

[57] ABSTRACT

A tamper evident document for use with an impact printer having an inked ribbon, which document comprises, a substrate having a first surface and a second surface, the first surface being adapted to receive a principal visible colored image by transfer from the inked ribbon of an impact printer and being substantially free from color forming compositions which react to form visible colored images, the second surface being coated with a self-contained pressure-sensitive chromogenic composition capable of reacting to form a visible colored mirror image on the second surface, the substrate being sufficiently translucent such that the second visible colored mirror image could be viewed from the first surface, if said second visible image were not totally blocked by said principal visible image, so as to determine whether the principal and second visible colored mirror images are in register.

22 Claims, 3 Drawing Sheets

PRESSURE-SENSITIVE TAMPER EVIDENT SYSTEM

FIELD OF THE INVENTION

The present invention relates to a tamper evident document useful with impact printers. More particularly, this invention relates to tamper evident security documents having a pressure-sensitive, self-contained or autogenous chromogenic coating on the rear side of the document, that can be activated to produce a visible colored mirror image for determining authenticity of the document by visual image registration.

BACKGROUND OF THE INVENTION

Various methods of providing security documents, such as negotiable instruments, with tamper evident systems to prevent alteration have been proposed. More specifically, pressure-sensitive autogenous coatings comprising color developer and encapsulated color former have been used to verify the authenticity of security documents. Once an external pressure is applied to the coating, microcapsules rupture and release the color former which then reacts with the color developer to form a colored image. This autogenous coating may be present on the front side, the rear side, or both sides of the document. After the important information is entered on the front side, the security document could later be tampered by one with ill intention. The use of a chromogenic coating thus provides a safeguard against tampering. For example, if a document is altered, the microcapsules in the altered area will rupture, causing release of the color former to react with the color developer. This unanticipated coloration displays a sign of tampering. If a document is duplicated by a copy machine, its authenticity may be determined by applying external pressure to the autogenous coating to form a visible colored image. The appearance of such instant in situ image confirms that the document is authentic.

U.S. Pat. No. 4,846,502 to Chang et al. discloses that a first autogenous coating may be applied on the front surface of a document bearing a principal image. A second localized autogenous coating is additionally applied on the rear surface of the document directly opposite and at least generally coextensive with the first coating to provide double protection. Any attempt to alter the imprinted visible indicia on the autogenous coating of the front side will simultaneously form a warning color in both front and rear coatings. Due to its autogenous nature, the rear side coating develops the mirror image of the indicia once such entry is initially made onto the front side coating. This not only permits the imprinting of a mirror image of the monetary amount, for example, as in the case of postal money order, but also serves as a tamper evident device for the principal or mirror image.

The Chang '502 patent also reveals there may be a localized carbon transfer medium on the front side of a lower transfer sheet, which is adjacent to the rear side autogenous coating and may produce a mirror image in the form of a carbon black on top of the rear side autogenous coating. Regardless of how it is formed, this carbon black image serves as an irrevocable reference. If it coincides with the front side image, it validates the authenticity of the negotiable instrument. On the other hand, if these images differ because of forgery, it suggests that the original imprinted visible indicia have been falsified. However, the tamper evident system of the Chang '502 patent always includes an autogenous coating which is in the form of a latent message, such as VOID, underneath the principal image on the front side of the document and has a second localized autogenous coating at least directly opposite the area of the principal image on the rear side of the document. Otherwise, an additional lower sheet having a localized carbon transfer medium or an inked typewriter ribbon is required to produce the mirror image. For practical purposes, this system is applicable for documents in which the second localized autogenous coating can be predetermined, such as a postal money order, a cashier's check, checks, certificates, preprinted documents, etc.

U.S. Pat. Nos. 5,395,138 and 5,605,873 to Chang disclose a localized pressure-sensitive autogenous system to verify the authenticity of a negotiable instrument, such as a bank check. Thus, when the check is submitted for payment at a bank, for example, the teller can verify the authenticity of the check by simply applying external pressure, such as by use of a fingernail or stylus, to the verification area conveniently located adjacent the endorsement area of the check before cashing the check. The autogenous spot coating may be located anywhere on the rear side of the document and does not need to be directly opposite the principal image on the front side.

The article "Security Document", Research Disclosure No. 187, November 1979, pp. 638–639, reports that by incorporating pressure-sensitive copy image forming means on the rear surface of a security document, the external pressure to imprint indicia on the front surface of the document also causes the formation of additional immediate image on the rear side of the document. If the indicia are subsequently lifted off using a correctable typewriter ribbon and different indicia are entered, the alteration will be visibly apparent from the image on the rear side, since the resultant double image is easily recognizable. The coating may be over the entire rear surface of the document or in the verification areas. This double image formation is caused by rupture of image-forming material from the microcapsules.

Autogenous copy systems have been widely used in many applications, such as business forms, sales receipts, duplicate of checks, pressure-sensitive labels, and the like. In these applications, the coating is on the front surface so that the image developed by the external pressure serves as the indicia for the document. Use of an inked ribbon is not required to transfer images onto the self-imaging coating. Since the coating is "live" at all times, any unintended pressure which may rupture the microcapsules, such as scratching by a hard object, folding, writing pressure when inadvertently placed underneath another substrate, etc., will develop unwanted image in the principal image areas.

SUMMARY OF THE INVENTION

A tamper evident security system has now been discovered which provides a simple and effective means for verifying the authenticity of security documents, such as cash register receipts used with impact printers. Despite the advent of laser and inkjet printers, impact printers remain widely used to process security documents. Likewise, attempts to illicitly reproduce such security documents are on the increase.

It has now been found that a tamper evident document for use with an impact printer can be provided which is both simple to authenticate and very difficult to photoduplicate with a color copier. The tamper evident document of the present invention comprises a substrate having a first surface and a second surface with the first surface being adapted to receive a principal visible colored image from the inked ribbon of an impact printer. Preferably, the first surface is substantially free of color-forming compositions which react to form visible colored images when the principal visible image is formed. The second surface is opposite the first surface of the substrate and is at least partially coated with a self-contained pressure-sensitive chromogenic composition capable of forming a visible colored mirror image on the second surface, which is a mirror image of the principal visible image. The self-contained pressure-sensitive chromogenic composition comprises a mixture of (a) chromogen or color-former and (b) a color developer capable of reacting with the color former to form a visible colored mirror image. At least one of the color former or color developer is separately encapsulated in pressure-rupturable microcapsules. Preferably, the color former is encapsulated. The color former is released from the microcapsules which are ruptured under pressure applied by the stylus of the impact printer when forming the principal image. The substrate must be sufficiently translucent to permit viewing of the principal visible colored image from the second surface with the naked eye with background lighting, if the principal visible colored image were not totally blocked by the visible colored mirror image, so as to determine whether the principal visible colored image and the visible colored mirror image are completely aligned, i.e., in register.

Thus, for example, if the security document of the present invention is a cash register receipt or sales slip returned to a grocery store with one or more listed food items for a cash refund, the clerk can first observe whether there are mirror images of the food items on the back of the receipt, which mirror images should be of a different color from that of the inked image, if the store uses different colors for the images provided by the inked ribbon and chromogenic composition, respectively. Next, the clerk can further verify the authenticity of the receipt by holding the receipt in front of background light, if necessary, to see if the inked principal image produced by the inked ribbon on the front of the receipt is in total visual alignment with the visible mirror image formed by the self-contained pressure-sensitive coating on the back of the receipt. If the front and back images are not in visual register, the clerk knows immediately that the sales receipt is not authentic. The sales receipt of the present invention is extremely difficult to duplicate with two-sided color photocopying because of the great difficulty in aligning the front and back images in exact register, particularly in the case of receipt paper, because of its non-standard size for copy machines.

According to a preferred embodiment of the invention, the principal visible colored image is a first color and the visible colored mirror image is a second color different from the first color.

According to another embodiment of the present invention, at least one of the major dimensions of the document is less than about eight inches.

According to a further embodiment of the present invention, a tamper evident printing system is provided which comprises an impact printer having an inked ribbon capable of providing colored visible images of a first color under the impact of the printing stylus of the impact printer, and a tamper evident security document comprising a substrate having a first surface and a second surface, the first surface of the substrate being adapted to receive the principal visible colored image from the inked ribbon of the impact printer and being substantially free from color forming compositions which react to form visible colored images. The second surface of the substrate is opposite the first surface and is at least partially coated with a self-contained pressure-sensitive chromogenic composition capable of forming a visible colored mirror image on the second surface which is a mirror image of the principal visible colored image upon rupture of said pressure-rupturable microcapsules under the impact of said impact printer during formation of the principal image. The substrate is sufficiently translucent such that the principal visible colored image could be viewed from the second surface with background lighting, if the principal visible image were not totally blocked by a colored mirror image, so as to determine whether the principal visible colored image and the visible colored mirror image are in register.

According to a still further embodiment of the present invention, a method is provided for authenticating a security document which comprises printing a tamper evident security document comprising a substrate having a first surface and a second surface, the first surface of the substrate bearing a principal visible colored image from the inked ribbon of an impact printer, the second surface of the substrate being opposite the first surface and having a coating of a self-contained, pressure-sensitive chromogenic composition that has reacted to form a visible colored mirror image on the second surface, which is a mirror image of the principal visible colored image upon rupture of said pressure-rupturable microcapsules under the impact of the impact printer during formation of said principal image. The substrate is sufficiently translucent such that the principal visible colored image could be viewed from the second surface with background lighting, if the principal visible image were not totally blocked by the visible colored mirror image, so as to determine whether the principal visible colored image and the visible colored mirror image are in register. The security document is presented for exchange for a valuable consideration to an exchange authority. The exchange authority receives the security document and holds the security document in front of a visible light source to view and determine whether the principal visible colored image and the visible colored mirror image are in register, thereby indicating that the presented security document is authentic or is an attempted color photoduplication of the security document.

BRIEF DESCRIPTION OF THE DRAWINGS

Referring now to the drawings which form a part of the original disclosure.

DETAILED DESCRIPTION OF THE INVENTION

Figure 1:
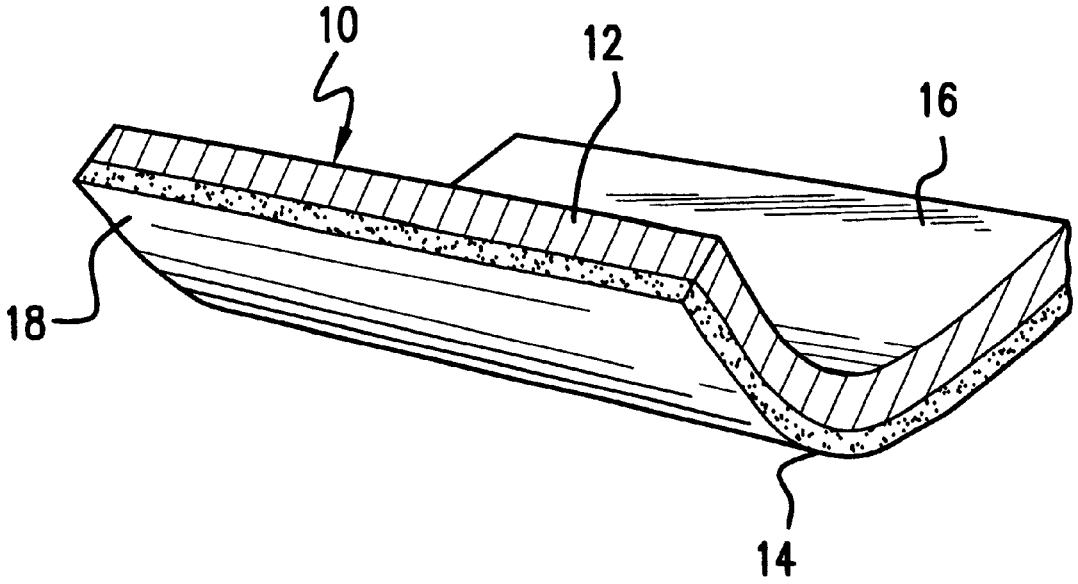
FIG. 1 is a perspective view, essentially schematic, of a tamper evident, pressure-sensitive document in accordance with the present invention.

Referring to FIG. 1, a security document 10 in accordance with the present invention having a support or substrate 12 is shown fully coated on its back or underside with a pressure-sensitive, self-contained or autogenous coating 14 comprising a combination of color formers and color developers, one or both of which may be disposed in pressure-rupturable microcapsules. The color formers and color developers of the present invention are each substantially colorless, as is the self-contained coating, until it is subjected to pressure to form a visible colored mirror image.

The pressure-rupturable microcapsules useful in the autogenous system of the present invention may be formed in any suitable manner conventionally employed. For example, the preparation of suitable microcapsules is described in U.S. Pat. Nos. B1 4,425,386 and 4,317,743, both to Chang, which patents are hereby incorporated by reference in their entirety.

The color former to be encapsulated may be any suitable chromogen, such as crystal violet lactone, diarylmethanes, triarylmethanes, indolylphthalides, fluorans, and spiropyrans. Exemplary diarylmethanes include 4,4'-bis (dimethylaminobenzhydrylbenzyl)ether, N-halophenyl leuco auramine, and N-2,4,5-trichlorophenyl leuco auramine. Examples of triarylmethanes include 3,3-bis(p-dimethylaminophenyl)-6-dimethylaminophthalide and 3,3-bis(p-dimethylaminophenyl)phthalide. Examples of indolylphthalides include 3-(p-dimethylaminophenyl)-3-(1,2-dimethylindole-3-yl)phthalide, 3,3-bis(1-octyl-2-methylindol-3-yl)phthalide and 3-(p-dimethylaminophenyl)-3-(2-methylindole-3-yl)phthalide. Examples of fluorans include 2-chloro-3-methyl-6-diethylaminofluoran, 3,6-dimethoxyfluoran, 2,4-dibutyl-6-diethylaminofluoran, 3-chloro-6-(N-cyclohexylamino) fluoran, 7,7'-bis(3-diethylaminofluoran), 2-anilino-3-methyl-6-diethylaminofluoran and 2-dibenzylamino-6-diethylaminofluoran. Examples of spiropyrans include 3-methylspirodinaphthopyran, 3-ethylspirodinaphthopyran, 3,3'-dichlorospirodinaphthopyran, 3-benzylspirodinaphthopyran, and 3-methylnaphtho-(3-methoxybenzo)spiropyran.

Suitable color developers are electron acceptor Lewis acids. Preferred materials include zincated alkylphenol-formaldehyde novolak resins, zinc salts of alkylsalicylic acids and acid activated clays.

Support 12 is, for example, a paper web having a surface 16 for receiving a principal image from an inked ribbon impact printer. Preferably, surface 16 is not coated with any self-contained pressure-sensitive chromogenic composition. The self-contained, self-imaging coating 14 is applied only to the rear surface of the document. Any unintended pressure will only create the unwanted marks on the rear side of the document, leaving the principal image surface 16 smudge-free. Even so, the extra unwanted marks do not affect the visual matching of most of the indicia.

Substrate 12 may be any suitable material, preferably a paper web, which is sufficiently translucent when held in front of a light source, such as the artificial light of an incandescent light bulb or fluorescent light, or natural window light, to visually determine if the colored mirror image of the indicia or the like, which is formed in the self-contained coating when the stylus of the impact printer strikes the front, uncoated surface of the substrate and ruptures the pressure-sensitive microcapsules of the self-contained coating on the back or underside of the substrate, is in alignment with the image on the front surface. Thus, for example, when the sales receipt paper of the present invention is printed and the sales slip held in front of a 60 watt light bulb, one should be able to see from the back side of the sales receipt only the red mirror image of a word or numeral provided by the self-contained pressure-sensitive coating on the back of the receipt. One should be able to see the principal inked image of the word or numeral provided by the inked ribbon only from the front of the sales receipt, and not be able to see portions of the principal inked image from the back of the receipt.

The sales receipt may be viewed from either surface to determine if it is authentic. However, since the inked principal image will normally be printed from a black inked ribbon and the mirror image will normally be a lighter color, for example, a red color, it will be easier for the authenticating person to spot an illicit reproduction of the document, if the receipt is viewed from the rear surface bearing the lighter color. Regardless of whether one is viewing an illicit photocopy of the sales receipt from the front surface or rear surface with background light, if necessary, one will also see portions of the word or numeral, which are on the opposite surface, through the receipt, since the black and red images will not be in register, i.e., in complete alignment.

Thus, a suitable substrate 12 includes, for example, paper having a sufficiently low basis weight to enable one to see the principal visible colored image formed on the front surface 16 upon viewing the paper from the back or rear surface 18 of the substrate with the aid of background light behind the front surface. Thus, paper having a basis weight, for example, in the range of 8 to about 32 pounds per 1300 square feet, preferably 10 to about 20 pounds per 1300 square feet, with 15 pounds per 1300 square feet being especially preferred. A suitable amount of self-contained coating 14 is, for example, between about 0.5 and about 2.5 pounds per 1300 square feet, preferably from about 0.7 and about 1.4 pounds per 1300 square feet.

If desired, substrate 12 may be treated to render it more translucent thereby reducing the amount of background light needed, and comprise, for example, a paper web that has been treated with a translucentizing agent, such as an oily solution of a natural wax, which can be, for example, paraffin wax, microcrystalline waxes, mineral waxes, vegetable waxes, etc., as well as synthetic waxes, including hydrocarbon waxes, e.g., linear polyethylene waxes, fatty acid esters, etc. Solutions of such waxes in natural oils, such as mineral oil, vegetable oil, cotton seek oil, coconut oil, etc., or synthetic oils, such as non-aromatic hydrocarbon oil, synthetic esters, or the like, may be utilized to form the waxy solution that is applied to the paper web. The translucentizing agent can have printing ink-like consistency for easy application to the paper web on a printing press, either over the entire or selected areas of the web. The translucentizing agent may be applied at any desired concentration to obtain the desired degree of translucency in the paper web. For example, the translucentizing agent may be applied to a paper web at a weight of from about 0.1 to about 1 pound per 1,300 square feet of area, preferably from about 0.1 to about 0.5 pound per 1,300 square feet. The preferred basis weight of a web is about 10 to about 20 pounds per 1,300 square feet.

The term "semi-translucent substrate or substrate" as used herein in connection with the support 12, means that the support, e.g., a paper web, has a sufficiently low basis weight that the principal inked image on the front of the web can be viewed with the naked eye through the web from the back or opposite side of the web with the aid of background light. Also, such "semi-translucent" support has not been treated with a translucentizing agent, but is untreated in this connection.

The term "translucent support or substrate" as used herein in connection with the support 12 means that the support is sufficiently translucent that colored markings on the underside of the web can be easily viewed with the naked eye through the web from the top side of the web without background light. Thus, ordinary cash register receipt paper that had not been treated with a translucentizing agent would be termed "semi-translucent", since some background light would be required to view the self-contained image from the front surface of the receipt.

Although the preferred semi-translucent and translucent support webs are ordinary paper, suitable translucent supports may be formed from materials including polyethylene films, highly aromatic polyamide synthetic films, polyester films and other synthetic substrates.

The formation of supports herein termed "translucent" is shown in U.S. Pat. No. 4,448,445 to Chang et al., the total disclosure of which is hereby incorporated by reference.

The security document of the present invention may be used for any document which might be photoreproduced for illicit purposes, such as a cash register receipt or sales receipt, pharmaceutical prescription, personal check, lottery ticket, sweepstakes award, or other negotiable instrument, such as contracts, letters, deeds, wills, bills of exchange, certificates of deposit etc. For illustrative purposes, reference hereinafter will be made to cash register or sales receipts.

Figure 2:
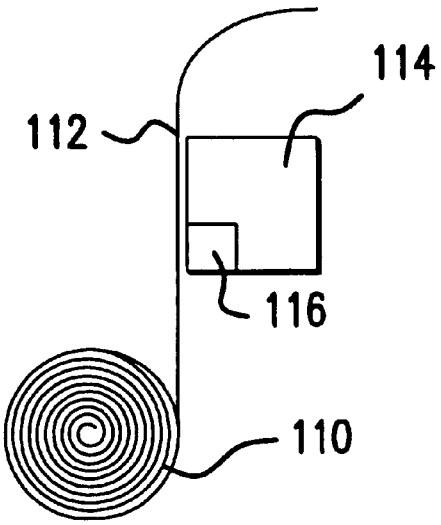
FIG. 2 is a partial, schematic and side elevational view of a continuous form cash register receipt form being contacted with the stylus of an impact printer using an inked ribbon.
Figure 3:
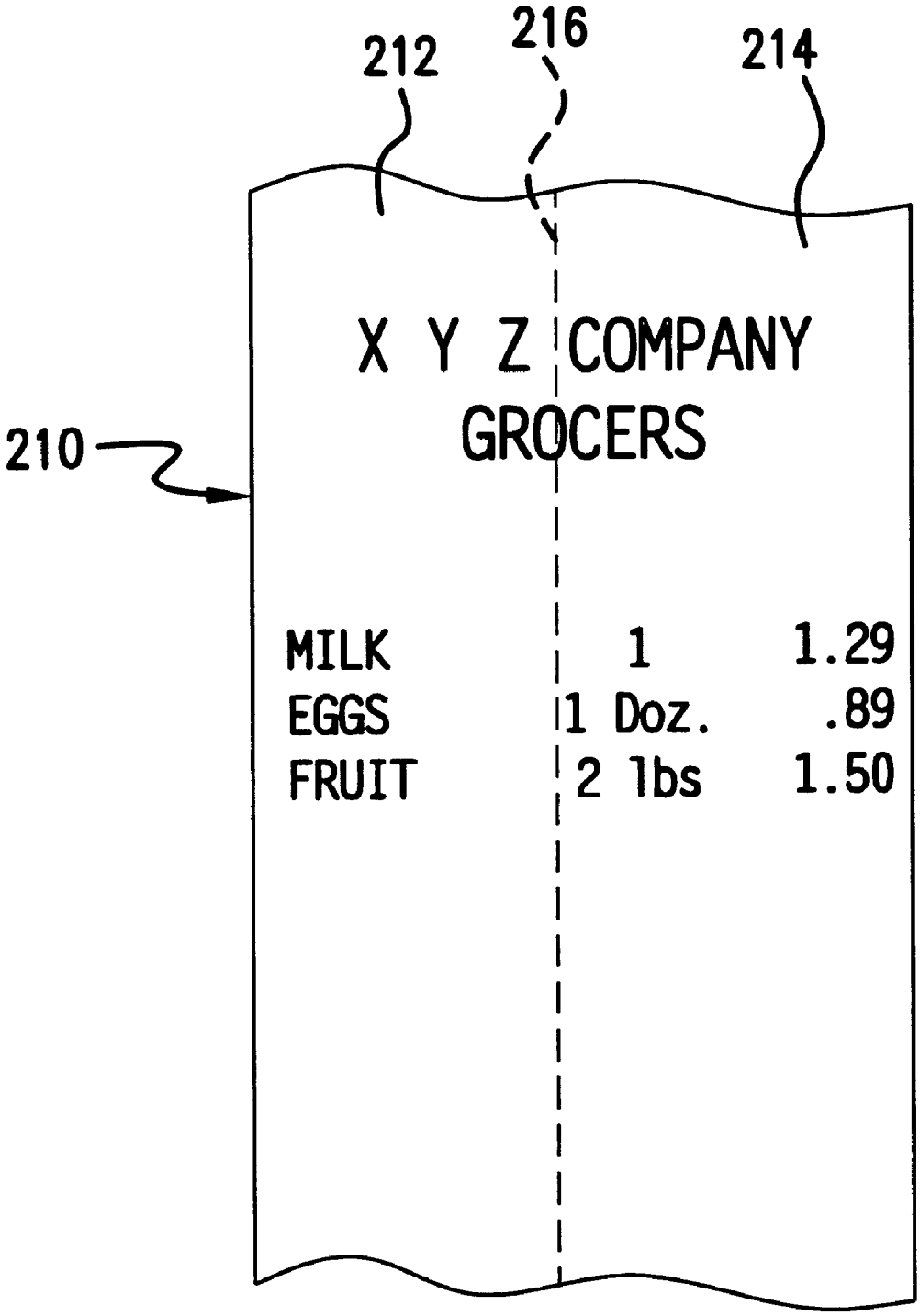
FIG. 3 is a front partially sectioned view of a cash register receipt having impact printed information in accordance with the present invention.

Referring to FIG. 2, a schematic presentation is shown in which continuous cash register or sales receipt form paper in the form of a sales register roll 110 having a self-contained pressure-sensitive coating on the rear surface, as in FIG. 1, is installed in a cash register and is being fed such that the uncoated, front surface of the receipt form 112 is printed by impact printer 114 having an inked ribbon 116 to provide a principal colored visible image on sales receipt form 112, for example, in the form of the information illustrated in FIG. 3. The color provided by the inked ribbon may be black or any other suitable color, e.g., red, green, yellow, or the like. Preferably, the color provided by the inked ribbon is different from that provided by the self-imaging composition on the back of receipt form 112 so as to provide a sharp color contrast when the sales receipt is viewed to determine whether illicit photocopying has occurred. The impact pressure of the stylus of impact printer 114 on inked ribbon 116 transfers the principal indicia in a first color, e.g., black, onto the front surface of the sales receipt form to form the principal image. The impact pressure from the stylus of printer 114 simultaneously ruptures the color former-containing microcapsules on the rear surface of form 112, releasing the color former to react with the color developer to form the mirror image of the principal image in a second color on the rear surface of the receipt.

Referring to FIG. 3, a cash register receipt or sales receipt 210 is shown with the principal image words "XYZ Company GROCERS", "MILK", "EGGS" and "FRUIT", the price and quantity of such items, all of which may be provided, for example, in a black color by the inked ribbon of an impact printer. The back or rear surface of receipt 210 may be partially coated, or preferably, fully coated with one or more self-imaging composition(s) over the entire back surface of receipt 112 because the negotiable instruments of this invention do not require predetermined areas for indicia to be entered on the front side. The self-contained coating may optionally be in a single stripe or in multiple stripes along the longitudinal direction using different color-yielding chromogens. The coating may also be in a single stripe or multiple stripes along the latitudinal direction. Each stripe of chromogenic coating may develop the same second color or each may be in a different color. The self-contained coating may be provided on the rear surface of sales receipt 210 as a partial or full coat, as desired, so long as there is a self-contained coating opposite at least a portion of the principal image that is provided on the front surface of sales receipt 210 by the inked ribbon 116 of impact printer 114.

To facilitate detection of a duplicated forgery, it is desirable for the autogenous or self-contained coating to present a striking color contrast to that of the principal image formed by the inked ribbon. For example, if the dollar amount on cash register receipt 210 is in black numerals, the color developed by the autogenous coating is preferably red, violet, orange, green, blue or yellow to obtain a high degree of contrast. For illustrative purposes, receipt 210 is coated on the back surface only under area 212 in a continuous longitudinal stripe with a red color-producing self-contained pressure-sensitive coating and, thus, the visible information appearing to the left of boundary line 216 of the self-contained coating appears as a mirror image in red on the back side of area 212. Thus, the self-contained coating in area 212 converts the area under area 212 into a verification zone to authenticate that sales receipt 210 is genuine. If receipt 210 were fully coated with a self-contained coating on the back side of receipt 210, the entire self-contained coating would form a verification zone capable of providing a mirror image of a principal image. The back surface of receipt 210 under area 214 is free of self-contained coating.

Figure 4:
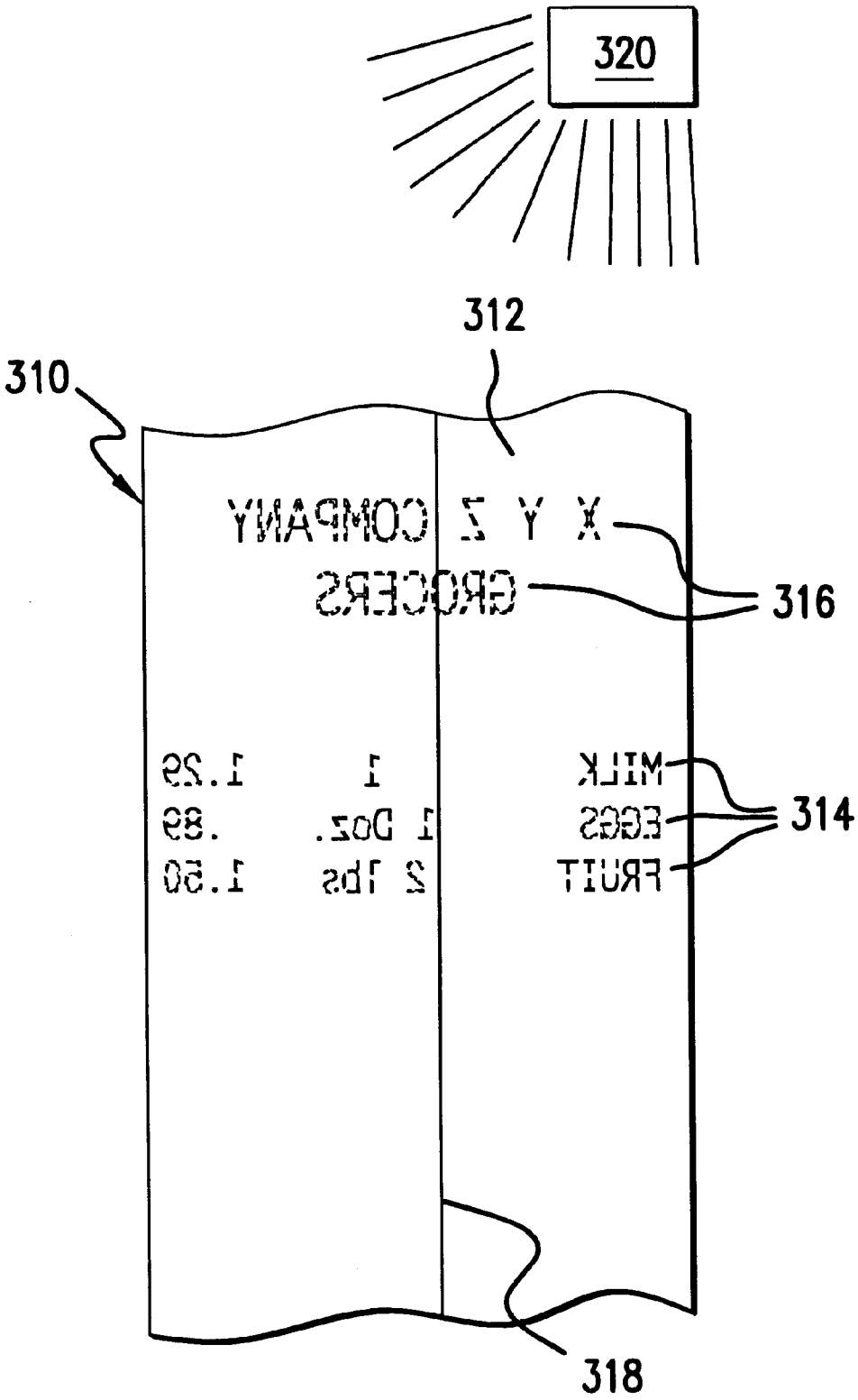
FIG. 4 is a rear partially sectioned view of an illicit, photoreproduction of the cash register receipt of FIG. 3.

Referring now to FIG. 4, the rear or back side of a cash register receipt 310 is depicted which is an illicit color photoduplication of the receipt of FIG. 3 in which an attempt was made to reproduce the black visible images on the front surface of sales receipt 210 and the underlying red visible mirror images on the back surface of sales receipt 210 under area 212, which were formed on sales receipt 210 by reaction of the color former with the color developer following release of the color former from the ruptured microcapsules upon pressure impact of the impact printer stylus on the front surface of the receipt. However, difficulties are encountered by the counterfeiter using a color photocopier to align the black images on the front surface of a receipt form 310 with corresponding red mirror images on the back surface of the receipt form 310 in area 312.

Thus, when one views the sales receipt from the rear surface of the receipt with background light as illustrated in FIG. 4, the commodity images 314, "MILK", "EGGS" and "FRUIT", and the portion of the company name images 316, "XYZ" and "GR" and a portion of the "O" appear distorted. The ribbon-produced, black, front images and the self-contained, pressure-sensitive chromogen-produced red, rear mirror images are not in register, i.e., in total alignment, and portions of the underlying black images can be seen from the rear surface of the receipt out of register with the red images in area 312. Thus, the grocery store employee, such as the store manager, when presented with the bogus receipt of FIG. 4 together with stolen milk, eggs and fruit for cash can hold the receipt up to a background light source 320, if necessary, which may be artificial light from incandescent, fluorescent lighting or natural sunlight through a window, and easily see the distortion. He can then refuse to issue a refund on this basis.

It is extremely difficult, if not impossible to align images using the two-sided photocopying feature of color photocopiers, particularly when the paper is not the standard letter or legal sized paper. Accordingly, when it is attempted to photoduplicate the two sides of receipt paper in color, for example, which is supplied to stores and other business establishments in rolls of paper having a width of about 2.25 inches, it is virtually impossible to make a two-sided color photocopy of the receipt with the mirror images in alignment using commercially available color copiers. Accordingly, preferred security documents of the present invention have a major dimension less that 8.5 inches, which is a standard width for letter and legal size paper. Thus, preferred documents of the present invention have a width of, for example, from about 1 to about 8 inches, with from about 2 to about 5 being especially preferred. Thus, receipt paper supplied in rolls having a width of 2.25 inches is an example of a preferred substrate in accordance with the present invention.

EXAMPLE

Autogenous or self-contained coating material is prepared by mixing the following components: 30 grams of capsule slurry (32.2 percent solids, containing 0.5 gram of 3,3-bis (1-octyl-2-methylindol-3-yl)phthalide (commercially available as Pergascript I-6B from Ciba-Geigy Corporation as a red color former), 11 grams of HRJ-4002 (48.6 percent solids, a phenolic novolak resin commercially available from Schenectady International, Inc. as a color developer), 15 grams of Resinset 656-4(65 percent solids, a melamine-formaldehyde prepolymer commercially available from Capital Resin Corporation, Columbus, Ohio), 15 grams of Keestar-328 (a wheat starch powder commercially available from ADM Corporation, Decatur, Ill.), and 0.5 grams of SE-21 (40 percent solids, a defoamer commercially available from Wacker Silicone Corporation, Adrian, Mich.).

The resultant mixture is coated on a plain paper substrate having a basis weight of 15 pounds per 1300 square foot. The coat weight is about 2 pounds per 1300 square foot.

A 2.25 inch wide strip of the coated dry paper, with the plain, uncoated front side facing the printer keys is fed to an impact printer equipped with a black ink ribbon and imprinted. Visible principal indicia in black color appear on the front side of the paper and visible mirror images in red color instantly develop on the rear side of the paper. The images are in total alignment.

Attempts to make a duplicate on a copy machine fails repeatedly.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A tamper evident document for use with an impact printer having an inked ribbon, which document comprises:

a substrate having a first surface and a second surface, said first surface being adapted to receive a principal visible colored image by transfer from said inked ribbon of said impact printer and being substantially free from color forming compositions which react to form visible colored images, said second surface being opposite said first surface and being at least partially coated with a self-contained, pressure-sensitive chromogenic composition comprising a mixture of a color former and a color developer in which at least one of said color former or said color developer is separately encapsulated in pressure-rupturable microcapsules, said color former and said color developer being capable of reacting to form a visible colored mirror image on said second surface upon rupture of said pressure-rupturable microcapsules under the impact of said impact printer during formation of said principal image, said substrate being sufficiently translucent such that said principal visible colored image could be viewed from said second surface, if said principal visible colored image were not totally blocked by said visible colored mirror image, so as to determine whether said principal visible colored image and said visible colored mirror image are in register.

2. The document of claim 1, wherein said substrate comprises paper having a basis weight in the range of about 10 to about 20 pounds per 1300 square feet.

3. The document of claim 1, wherein said second surface is fully coated with said self-contained, pressure-sensitive chromogenic composition.

4. The document of claim 1, wherein said principal visible colored image is a first color and said visible colored mirror image is a second color different from said first color.

5. The document of claim 4, wherein said first color is black and said second color is red.

6. The document of claim 2, wherein said substrate is cash register receipt paper.

7. The document of claim 1, wherein said substrate has a width below eight inches.

8. The document of claim 7, wherein said substrate has a width of about 2.5 inches.

9. The document of claim 1, wherein said substrate is semi-translucent.

10. The document of claim 1, wherein said substrate is translucent.

11. A tamper evident printing system for a security document which comprises:

an impact printer having an inked ribbon capable of providing a colored visible images of first color under the impact of a printing stylus, a tamper evident security document comprising, a substrate having a first surface and a second surface, said first surface of said substrate being adapted to receive a principal visible colored image by transfer from said inked ribbon of said impact printer and being substantially free from color forming compositions which react to form visible colored images, said second surface of said substrate being opposite said first surface and being at least partially coated with a self-contained, pressure-sensitive chromogenic composition comprising a mixture of a color former and a color developer in which at least one of said color former or said color developer is separately encapsulated in pressure-rupturable microcapsules, said color former and said color developer being capable of reacting to form a visible colored mirror image on said second surface upon rupture of said pressure-rupturable microcapsules under the impact of said impact printer during formation of said principal image, said substrate being sufficiently translucent such that said principal visible colored image could be viewed from said second surface if said principal visible image were not totally blocked by said visible colored mirror image, so as to determine whether said principal and second visible colored images are in register.

12. The printing system of claim 11, wherein said principal visible colored image is a first color and said visible colored mirror image is a second color different from said first color.

13. The printing system of claim 12, wherein said first color is black and said second color is red.

14. The printing system of claim 11, wherein said substrate has a basis weight in the range of from about 10 to about 20 pounds per 1300 square feet.

15. The printing system of claim 11, wherein said second surface of said substrate is fully coated with said self-contained, pressure-sensitive chromogenic composition.

16. The printing system of claim 11, wherein said substrate has a width of below eight inches.

17. The printing system of claim 11, wherein said substrate is semi-translucent.

18. The printing system of claim 11, wherein said substrate is translucent.

19. A method for authenticating a security document which comprises:

printing a tamper evident security document with an impact printer having an inked ribbon, said security document comprising a substrate having a first surface and a second surface, said first surface of said substrate bearing a principal visible colored image transferred from said inked ribbon of said impact printer, said second surface of said substrate being opposite said first surface and being at least partially coated with a self-contained, pressure-sensitive chromogenic composition comprising a mixture of a color former and a color developer in which at least one of said color former or said color developer is separately encapsulated in pressure-rupturable microcapsules, said color former and said color developer having reacted to form a visible colored mirror image having a second color upon rupture of said pressure-rupturable microcapsules under the impact of said impact printer during formation of said principal image, said substrate being sufficiently translucent such that said principal visible colored image could be viewed from said second surface with background lighting, if said principal visible image were not totally blocked by said second visible image, so as to determine whether said first and second visible colored images are in register, presenting said security document for exchange for a valuable consideration to an exchange authority, said exchange authority receiving said presented security document and holding said security document so as to view said security document and determine whether said principal visible colored image and said visible colored mirror image are in register, thereby indicating that said presented security document is authentic or is an attempted color photoduplication of said security document.

20. The method of claim 19, wherein said security document is a cash register receipt.

21. The method of claim 19, wherein said first color is black and said second color is red.

22. The method of claim 19, wherein said exchange authority views said security document with background lighting to view said security document to determine whether said principal visible colored image and said visible colored mirror image are in register.

* * * * *